US006491554B1

(12) United States Patent
Servais

(10) Patent No.: US 6,491,554 B1
(45) Date of Patent: Dec. 10, 2002

(54) WATERCRAFT WITH STEERABLE PLANING SURFACE

(75) Inventor: Jonathan Servais, Kenosha, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/614,186

(22) Filed: Jul. 11, 2000

(51) Int. Cl.[7] ..... B63H 11/113
(52) U.S. Cl. ..... 440/42; 440/40
(58) Field of Search ..... 440/40, 42, 43, 440/38; 114/284, 285, 286

(56) References Cited

U.S. PATENT DOCUMENTS

| | | | | | |
|---|---|---|---|---|---|
| 31,845 | A | | 3/1861 | Winans | |
| 1,484,881 | A | * | 2/1924 | Gill | 60/222 |
| 1,529,036 | A | | 3/1925 | Richey | |
| 1,780,767 | A | | 11/1930 | Scott-Paine | |
| 2,972,324 | A | | 2/1961 | Williams | |
| 3,097,623 | A | * | 7/1963 | Hamilton | 440/43 |
| 3,106,178 | A | | 10/1963 | Cale | |
| 3,146,586 | A | * | 9/1964 | Newby | 60/222 |
| 3,250,072 | A | | 5/1966 | Smith | |
| 3,422,788 | A | * | 1/1969 | Horan, Jr. | 440/41 |
| 3,442,244 | A | | 5/1969 | Clark | |
| 3,478,712 | A | * | 11/1969 | Fox | 440/41 |
| 3,710,749 | A | | 1/1973 | Duryea | |
| 3,742,893 | A | * | 7/1973 | Stelling | 440/42 |
| 3,831,539 | A | | 8/1974 | Black | |
| 3,906,885 | A | | 9/1975 | Woodfill | |
| 3,943,876 | A | * | 3/1976 | Kiekhaefer | 440/43 |
| 3,949,700 | A | * | 4/1976 | Baroody | 440/41 |
| 3,976,026 | A | * | 8/1976 | Eastling | 440/11 |
| 3,982,494 | A | | 9/1976 | Posti | |
| 4,437,841 | A | * | 3/1984 | Stallman | 440/42 |
| 4,831,954 | A | | 5/1989 | Kinouchi | |
| 4,949,662 | A | | 8/1990 | Kobayashi | |
| 5,094,182 | A | * | 3/1992 | Simner | 114/163 |
| 5,113,777 | A | | 5/1992 | Kobayashi | |
| 5,359,956 | A | | 11/1994 | Lee | |
| 5,387,141 | A | * | 2/1995 | Toyohara et al. | 440/41 |
| 5,421,753 | A | * | 6/1995 | Roos | 440/43 |
| 6,086,437 | A | * | 7/2000 | Murray | 440/43 |

FOREIGN PATENT DOCUMENTS

| | | | | |
|---|---|---|---|---|
| JP | 6-122398 | * | 5/1994 | 440/42 |

* cited by examiner

*Primary Examiner*—S. Joseph Morano
*Assistant Examiner*—Ajay Vasudeva
(74) *Attorney, Agent, or Firm*—Ostrager Chong & Flaherty LLP

(57) ABSTRACT

A watercraft having a turnable (i.e., pivotable) planing surface, preferably with at least one skeg projecting generally vertically downward from the planing surface. This structure is designed to provide improved steering performance of watercraft, particularly jet-powered boats, while minimizing drag. The turnable planing surface is formed by a bottom surface of a steering pad mounted beneath a jet propulsion unit. In one embodiment, the water jet propulsion unit is fixed (i.e., not turnable) and the skeg-bearing planing surface is turnable relative to the water jet propulsion unit. In another embodiment, the water jet propulsion unit is turnable relative to the hull centerline (e.g., in the manner of an outboard engine) and the skeg-bearing planing surface is fixed relative to the water jet propulsion unit (i.e., the skeg-bearing planing surface turns in unison with the jet propulsion unit). The planing surface may optionally have strake-like sides.

21 Claims, 5 Drawing Sheets

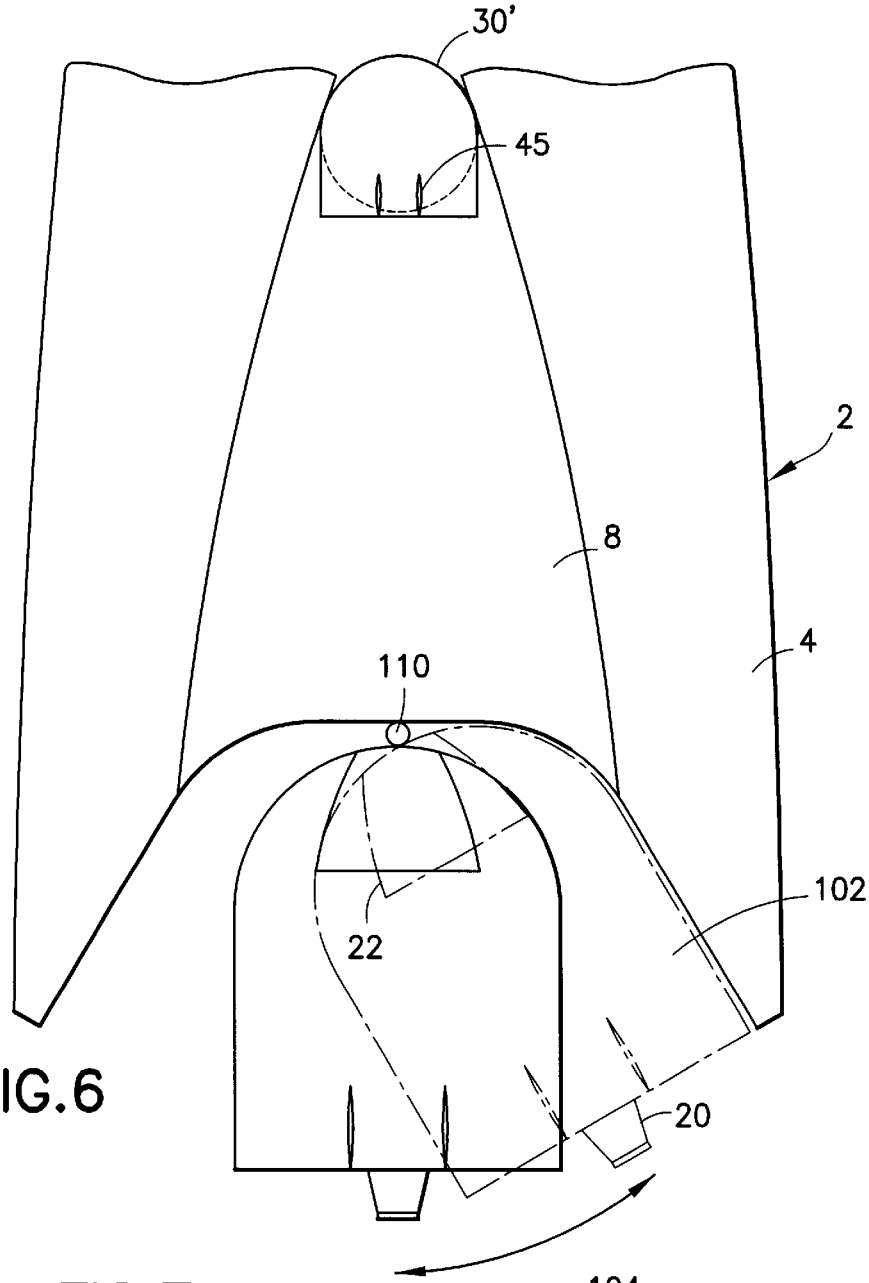
FIG.6
FIG.7
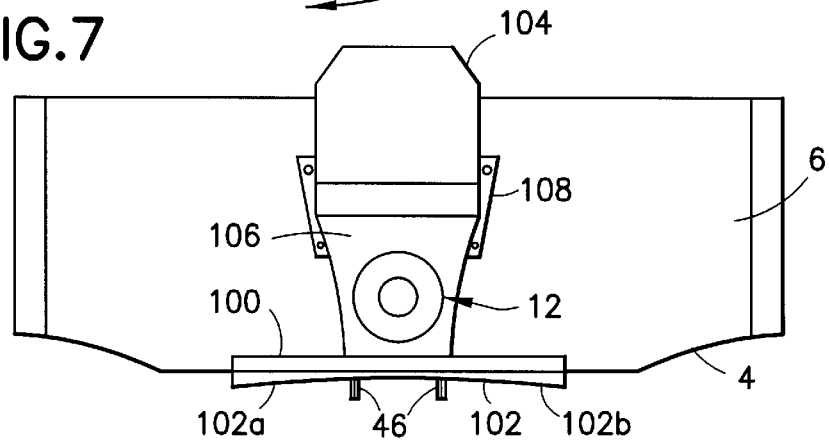

WATERCRAFT WITH STEERABLE PLANING SURFACE

FIELD OF THE INVENTION

This invention generally relates to mechanisms for steering powerboats and other watercraft.

BACKGROUND OF THE INVENTION

Powerboats can be categorized in part in accordance with the design of their hulls. There are basically two kinds of hull designs for powerboats: displacement hulls and planing hulls. Displacement hulls are designed for vessels intended for cruising through water, while planing hulls are incorporated in boats designed to lift a part of the hull out of the water to skim the water surface. Planing boats are typically used in activities which require high boat speed, such as water-skiing and powerboat racing.

Powerboats also differ in the types of propulsion systems used. The powerhead can be mounted either inside the hull or outside the hull. In the latter case, the powerhead is mounted on the transom portion of the boat hull and is detachable. Another type of system, called a stern drive system, and sometimes referred to an inboard-outboard system, utilizes a powerhead mounted inside the hull of the boat with a portion of the drive unit extending through the transom. These systems create thrust through rotation of either a propeller or an impeller, which draws water from ahead and impels the water rearward to propel the boat forward.

In a conventional "V" type hull, the bottom of the boat terminates at the transom. In boats of this nature, either an outboard motor can be set on the transom or a stern drive, which has a motor within the boat directly in front of the transom and a drive shaft penetrating the transom, can be used to power the boat. In these types of boats, the driving force is produced (e.g., by a propeller or an impeller) behind and below the rearmost portion of the boat. In other hull constructions, the bottom of the central portion of the hull actually terminates forward of the transom so that there is a step between the bottom of the hull and the transom, forming a pocket in which, e.g., a jet propulsion unit can be mounted.

When boats of either of the above general types go from a rest or idle condition to a full-speed planing condition, they must accelerate through a condition which is known as "getting on plane". When these boats are getting on plane, the angle of the boat in the water can be quite steep, which can hinder the visibility of the operator, as well as creating an inefficient running condition. Depending on the weight of the boat, the position of the load in the boat, and the power level of the engine, the condition of getting on plane can last an extended length of time. Once "on plane", the angle of attack of the boat with respect to the water will level off and visibility is restored to the operator. The term "planing surface", as used herein, refers to those portions of the hull surface which contact the water and support the weight of the boat when the boat is "on plane", and specifically excludes stationary, generally vertical surfaces used to provide lateral stability and control, e.g., sidewalls of strakes or skegs, and movable, generally vertical surfaces used in steering, e.g., surfaces of rudders.

The steering systems for boats and watercraft vary widely in design and construction. On some single-propeller, inboard-engine powerboats, the shaft and propeller are fixed along the centerline of the hull, and the boat is steered using a vertical rudder blade pivoted on a post and located near the stern of the boat in close proximity to the propeller. Outboard and stern-drive boats, on the other hand, generally use directed-thrust steering to propel and the steer the boat through water.

In the case of a jet propulsion unit mounted to the hull and driven by an inboard motor, the jet propulsion unit intakes water through an opening in the bottom of the hull and discharges it through a thrust nozzle for propelling the watercraft and then through a pivotally supported steering nozzle for steering the watercraft. The steering nozzle directs the exiting water jet to one side or the other, thereby causing a steering rotation or yaw of the vessel which, in combination with the characteristics of the bottom surface of the hull, produces a turning maneuver.

Although the foregoing type of steering device is advantageous under normal running conditions, i.e., when there is sufficient thrust to overcome the momentum and directional drag of the vessel, at low speeds the jet propulsion unit does not develop significant thrust and the steering effectiveness is greatly reduced. Thus there is a need for a means of providing a positive turning force when a jet drive unit of a watercraft is turned off or operating at low rpm's.

SUMMARY OF THE INVENTION

The present invention is directed to a watercraft having a hull with at least one turnable (i.e., pivotable) planing surface. In accordance with one preferred embodiment, the turnable planing surface is generally planar with at least one skeg or equivalent control surface projecting generally vertically downward from the planing surface. If two or more skegs are employed, these skegs are preferably parallel to each other. In a neutral position, the skegs are generally aligned with the centerline of the hull, causing no steering forces.

In accordance with another preferred embodiment, the turnable planing surface is a cylindrical section having a concave curved cross section, with opposing sides each having a strake-like structure. In a neutral position, the axis of the cylindrical section is generally aligned with the centerline of the hull, causing no steering force. In accordance with a more preferred embodiment, the turnable planing surface with strake-like sides is combined with at least one generally vertical, downwardly projecting skeg disposed between the strake-like sides.

Each of the above-described structures is designed to provide improved steering performance of watercraft, particularly jet-powered boats, while minimizing drag. Using a portion of the surface of the boat that is in contact with the water to provide the steering force improves the maneuverability of the boat.

In accordance with further preferred embodiments of the invention, a jet-powered watercraft is provided with a pair of skeg-bearing planing surfaces arranged along the centerline of the watercraft and turnable relative to that centerline. One turnable skeg-bearing planing surface is located in the foremost region of the area of the hull bottom which is wetted during planing and the other turnable skeg-bearing planing surface is mounted, either fixedly or pivotably, beneath the water jet propulsion unit. In one embodiment, the water jet propulsion unit is fixed (i.e., not turnable) and the skeg-bearing planing surface is turnable relative to the water jet propulsion unit. In another embodiment, the water jet propulsion unit is turnable relative to the hull centerline (e.g., in the manner of an outboard engine) and the skeg-bearing planing surface is fixed relative to the water jet propulsion unit (i.e., the skeg-bearing planing surface turns in unison with the water jet propulsion unit).

Preferably each turnable skeg-bearing planing surface comprises a bottom surface of a respective pivotable steering pad, with the area of the forward pad being less than the area of the rear pad. The front pad turns counter to the rear pad. The rear pad is designed to carry most of the boat weight at high speeds.

In accordance with another preferred embodiment of the invention, the front steering pad is provided mainly to enhance low-speed maneuverability. More specifically, means are provided for coupling the front steering pad to the steering wheel (and to the rear steering pad) only when the motor rpm's are less than or equal to a predetermined threshold and then uncoupling the front steering pad from the steering wheel (and from the rear steering pad) when the motor rpm's exceed the predetermined threshold.

BRIEF DESCRIPTION OF THE DRAWINGS

FIG. 6 is a schematic showing a bottom view of the stern portion of a jet-powered watercraft in accordance with a third preferred embodiment of the invention.

FIG. 7 is a schematic showing a rear elevation view of the watercraft depicted in FIG. 6.

DETAILED DESCRIPTION OF THE PREFERRED EMBODIMENTS

Figure 1:
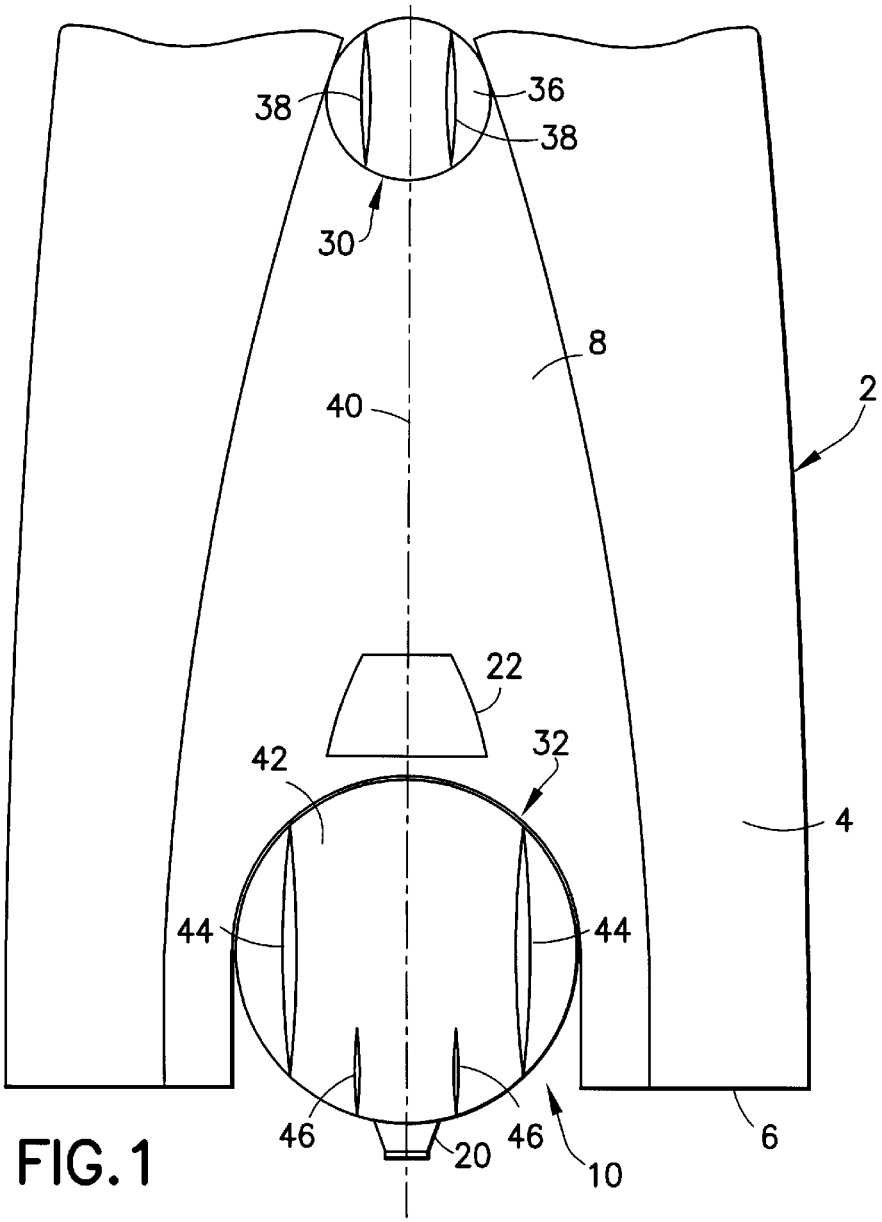
FIG. 1 is a schematic showing a bottom view of the stern portion of a jet-powered watercraft in accordance with one preferred embodiment of the invention.
Figure 2:
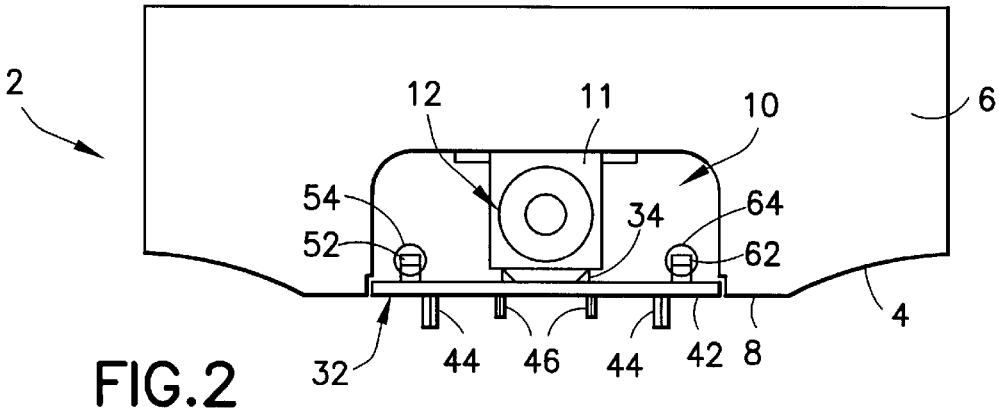
FIG. 2 is a schematic showing a rear elevation view of the watercraft depicted in FIG. 1.
Figure 3:
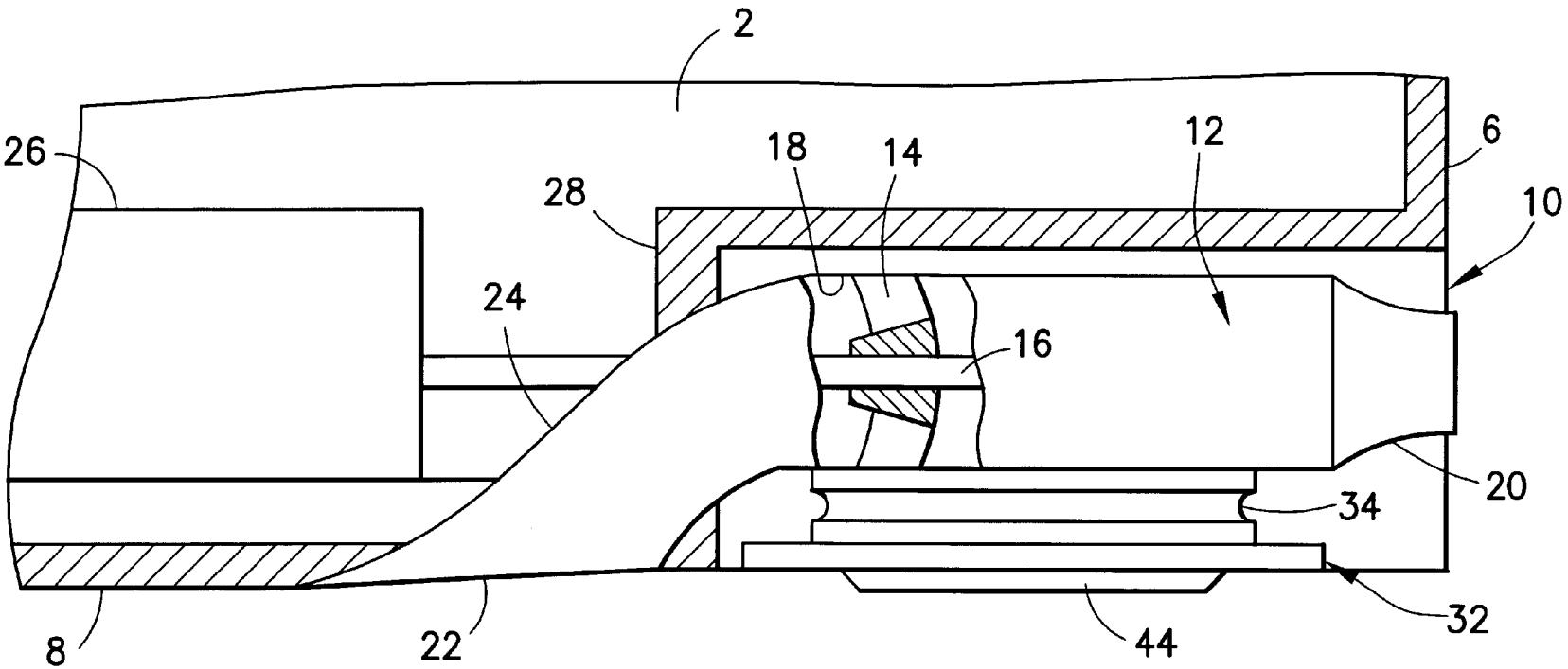
FIG. 3 is a schematic showing a sectional view of the stern portion of the watercraft depicted in FIG. 1.

A first preferred embodiment of the invention is depicted in FIGS. 1–3. A hull 2 comprises bottom 4, a stern wall or transom 6 and a bow (not shown). The hull bottom 4 comprises a planing surface 8, best seen in FIG. 1. Preferably the hull is fabricated by curing fiberglass in a mold.

Referring to FIGS. 2 and 3, a pocket 10 is formed in the hull 2. A water jet propulsion unit 12 is fixedly mounted within the pocket 10 by conventional support structure indicated by numeral 11 in FIG. 2. The water jet propulsion unit 12 typically comprises an impeller 14 (the hub of the impeller is shown sectioned in FIG. 3) mounted on a drive shaft 16 and a housing 18 which surrounds the impeller, forming a duct for impelled water to flow through when the impeller is rotated. The drive shaft 16 is driven by an inboard motor 26. The impelled water exits the housing 18 via a convergent thrust nozzle 20, which increases the water velocity. The water exiting the thrust nozzle 20 creates a reaction force which propels the boat forward. Although not shown in FIG. 3, it is well known that a steering nozzle can be pivotably mounted to the thrust.nozzle by means of a pair of pivot pin assemblies having pivot pins coaxial with a vertical axis. This allows the steering nozzle to be pivoted from side to side for directing thrust to one side or the other for the purpose of steering the boat.

As should be apparent from FIGS. 1 and 3, the rotating impeller 14 draws water in through a water inlet opening 22 formed in the planing surface 8 of the hull bottom 4 and along a duct 24. FIG. 3 shows a duct which connects an opening in the hull bottom with an opening in the vertical hull wall 28, which defines the front boundary of the pocket 10. The drive shaft 16 penetrates the duct 24. The duct 24 guides drawn water into the housing 18, where it is impelled rearward toward the thrust nozzle 20.

The jet-powered watercraft shown in FIGS. 1–3 is provided with a pair of disc-shaped steering pads 30 and 32. Each steering pad has a skeg-bearing planing surface centered along the centerline of the watercraft and turnable relative to that centerline. The front steering pad 30 is pivotably mounted in a recess in the hull bottom in the most forward portion of the hull planing surface 8. The rear steering pad 32 is pivotably mounted beneath the jet propulsion unit 12. The pads are preferably constructed of metal-reinforced fiberglass. In the preferred embodiment, the rear steering pad 32 is supported by a large taper bearing 34 attached and sealed to the pump housing. 18, as best seen in FIG. 3. Alternatively, the rear steering pad 32 could be pivotably mounted beneath the water jet propulsion unit by means of a flexible rubber mounting element having sufficient elasticity to allow twisting over a sufficiently wide range of steering angles.

In accordance with the preferred embodiment shown in FIG. 1, the front steering pad 30 comprises a generally planar planing surface 36, which is generally flush with the hull planing surface 8, and a pair of mutually parallel skegs 38. As used herein and in the claims, any reference to the orientation of a skeg refers to the orientation of a midplane of the skeg, that midplane being oriented along the length of the skeg. Each skeg 38 projects generally vertically downward from the planing surface 36. FIG. 1 shows the skegs 38 disposed in parallel with the hull centerline 40.

When the front steering pad is turned, however, the skegs 38 will be disposed at a non-zero angle relative to the centerline 40. In this case, the front steering pad will produce a lateral steering force which tends to turn the most forward portion of the hull planing surface 8 in the direction toward which the leading edges of the skegs 38 are pointing. The front steering pad is generally circular and resides in a circular recess in the hull of slightly greater radius.

The rear steering pad 32 also comprises a generally planar circular planing surface 42, but having a diameter greater than the diameter of the front steering pad. The planing surface 42 resides in the pocket 10 and is disposed at an elevation so that it is generally flush with the hull planing surface 8. As should be apparent from FIGS. 1 and 3, the vertical hull wall 28 of pocket 10 is preferably semicircular in cross section, with a radius slightly greater than the radius of the rear steering pad, allowing the disc-shaped rear steering pad to fit in the pocket 10 with little clearance between the vertical hull wall 28 and the pad. In accordance with the preferred embodiment depicted in FIGS. 1 and 2, the rear steering pad comprises a first pair of relatively long skegs 44 generally disposed along mutually parallel secants of the circle defined by the circumference of planing surface 42; and a second pair of relatively short skegs 46 extending forward from the trailing edge of the planing surface 42. All of the skegs 44 and 46 are mutually parallel. Skegs 44 are equidistant from the centerline of planing surface 42; likewise, skegs 46 are equidistant from the centerline of planing surface 42, with skegs 46 being located between skegs 44. Alternatively, any number of skegs may be provided on the rear steering pad. FIG. 1 shows the skegs 44 and 46 generally parallel with the hull centerline 40. When the rear steering pad is turned, however, the skegs 44 and 46 will be disposed at a non-zero angle relative to the centerline 40. In this case, the rear steering pad will produce a lateral steering force which tends to turn the most forward portion of the hull planing surface 8 away from the direction in which the leading edges of the skegs 38 are pointing, i.e., the stern is directed toward where the skeg leading edges are pointing, causing the bow of the boat to turn in the opposite direction. For example, if the leading edges of skegs 44 and 46 are pointing to the right, then the bow of the boat will turn to the left as the boat is propelled forward.

Each skeg (38, 44 and 46) is preferably a foil-shaped projection having a narrow width at its trailing and leading edges, a maximum width at its midpoint, and concave control surfaces on opposing sides which gradually curve from the leading and trailing edges to the midpoint in a streamlined shape. The bottom of each skeg is preferably rounded to reduce turbulence beneath the skeg. Optionally the leading edge of each skeg is rounded.

In accordance with the most preferred embodiment of the invention, the front and rear steering pads are turned in opposite directions when the boat is moving slowly, providing improved steering and enhanced maneuverability. Conversely, when the boat is traveling at high speed, the front steering pad is disabled and the rear steering pad is used for steering. Optionally, a steering nozzle may also be used for steering. In the latter case, the rear steering pad and the steering nozzle may be turned in tandem in the same direction.

Figure 8:
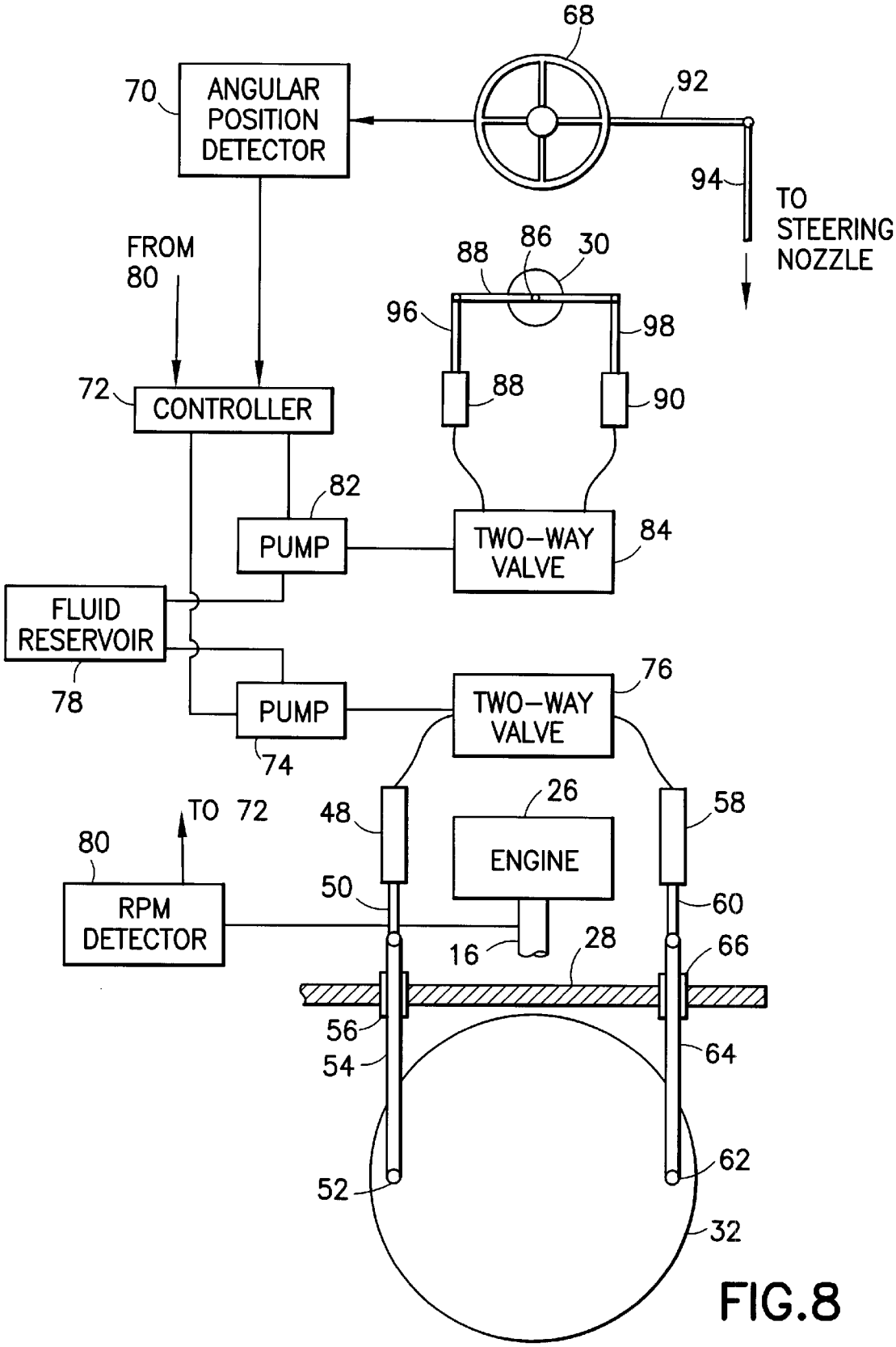
FIG. 8 is a schematic showing a system for controlling angular positions of front and rear steering pads in accordance with a preferred embodiment of the invention.

A system for controlling the front steering pad 30 as a function of the revolutions per minute of the engine is shown in FIG. 8. This figure also shows hydraulic cylinders for controlling the angular position of the rear steering pad 32. Hydraulic cylinders can also be used to control the angular position of the front steering pad.

In accordance with this preferred embodiment, a first hydraulic cylinder 48 has a piston 50 which is connected to one end of a rod or link 54, the other end of link 54 being pivotably coupled by a coupling 52 to the rear steering pad 32. The link 54 penetrates the wall 28 via a watertight seal 56. Similarly, a second hydraulic cylinder 58 has a piston 60 which is connected to one end of a rod or link 64, the other end of link 64 being pivotably coupled by a coupling 62 to the rear steering pad 32. The link 64 penetrates the wall 28 via a watertight seal 66.

The hydraulic cylinders 48 and 58 are selectively activated depending on which direction the boat operator is turning the steering wheel 68. The angular position of the steering wheel is determined by an angular position detector 70, which outputs an electrical signal representing steering wheel angular position to a controller 72. The controller 72 is programmed to control the angular position of the rear steering pad 32 as a function of the angular position of the steering wheel. More specifically, the controller 72 controls the on/off state of a pump 74 and the switching state of a two-way valve 76. In a first switching state, the valve 76 connects the pump 74 to the hydraulic cylinder 48; in a second switching state, the valve 76 connects the pump 74 to the hydraulic cylinder 50. In order to turn the rear steering pad 32 counterclockwise as seen in FIG. 8, the controller 72 switches the valve 76 to its first switching state and then turns pump 74 on, causing pump 74 to pump fluid from reservoir 78 into hydraulic cylinder 48. This in turns extends piston 50 and displaces link 54 rearward. The coupling of the rear steering pad to the remote end of the link 54 causes the pad to turn counterclockwise when link 54 moves rearward. Conversely, to move the rear steering pad 32 clockwise as seen in FIG. 8, the controller 72 switches the valve 76 to its second switching state and then turns pump 74 on, causing the latter to pump fluid from reservoir 78 into hydraulic cylinder 58. This in turns extends piston 60 and displaces link 64 rearward. The coupling of the rear steering pad to the remote end of the link 64 causes the pad to turn clockwise when link 64 moves rearward.

The angular position of the front steering pad is controlled in a similar manner, except that the front steering pad turns in a direction opposite to the direction in which the rear steering pad is turned. As seen in FIG. 8, the front steering pad 30 is pivotably mounted to the hull bottom by a vertical shaft 86, and can be turned in either direction by providing fluid from a pump 82 to either of two additional hydraulic cylinders 88 and 90 via a two-way valve 84. The hydraulic cylinders 88 and 90 have respective pistons 96 and 98 pivotably connected to respective ends of a horizontal crossbar 88, which is connected at its midpoint to the top of the vertical shaft 86. The controller 72 is programmed to control the angular position of the front steering pad 30 as a function of the angular position of the steering wheel 68 and as a function of the rpm's of engine 26. More specifically, the controller 72 controls the on/off state of pump 82 and the switching state of two-way valve 84. In a first switching state of two-way valve 84, hydraulic cylinder 88 is coupled to pump 82, causing the front steering pad 30 to turn in one direction, while in a second switching state of two-way valve 84, hydraulic cylinder 90 is coupled to pump 82, causing the front steering pad to turn in the opposite direction. The controller 72 is programmed to turn pump 82 on only when the engine rpm's are below a predetermined threshold, as determined by the rpm detector 80 coupled to the drive shaft 16 or crankshaft of the engine.

The steering wheel 68 can also be linked to a conventional steering nozzle (not shown) of the water jet propulsion unit via a lever 92 having one end fixed to the steering column and another end pivotably coupled to a link 94 (partly shown in FIG. 8). The other end of link 94 is pivotably coupled to a steering arm (not shown) on the steering nozzle. Thus both the rear steering pad and the steering nozzle can be turned in the same direction in unison to provide enhanced steering performance.

Figure 4:
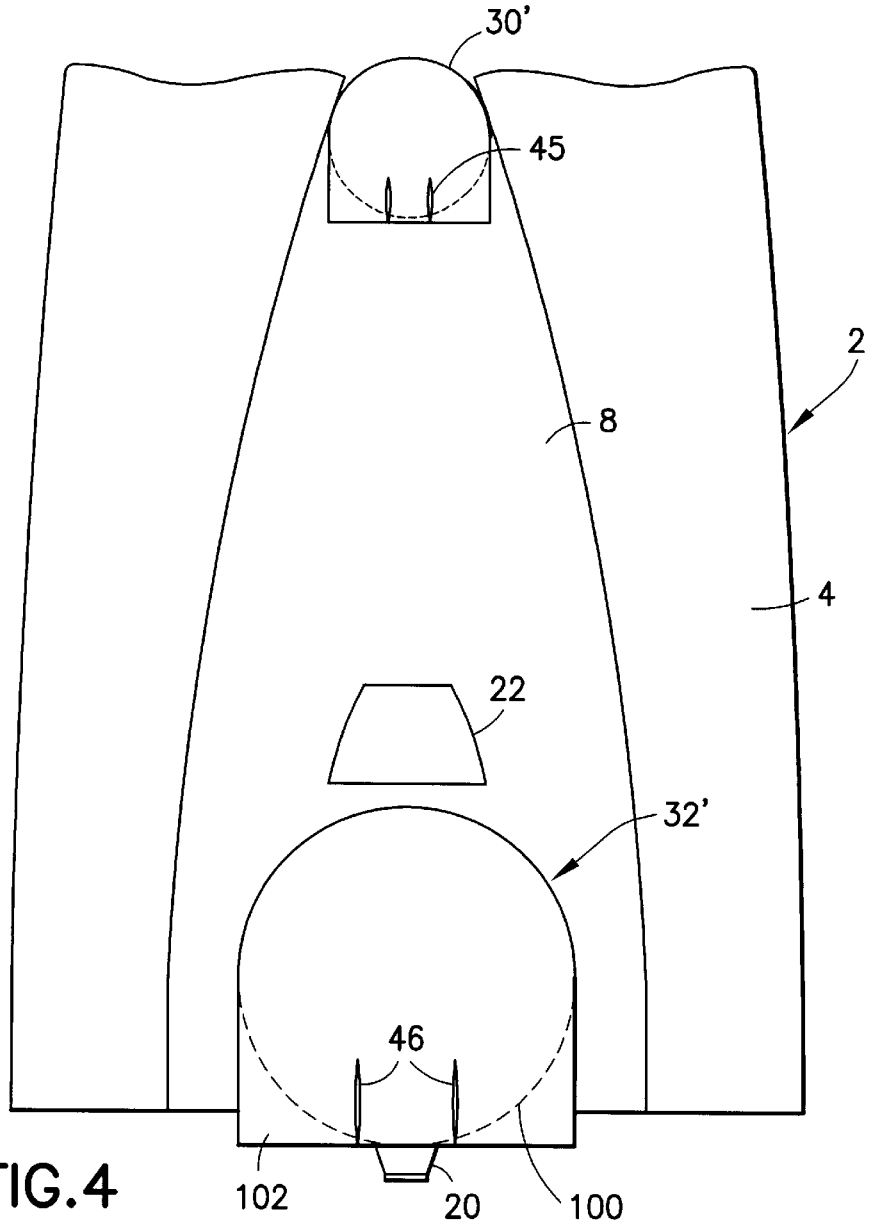
FIG. 4 is a schematic showing a bottom view of the stern portion of a jet-powered watercraft in accordance with a second preferred embodiment of the invention.
Figure 5:
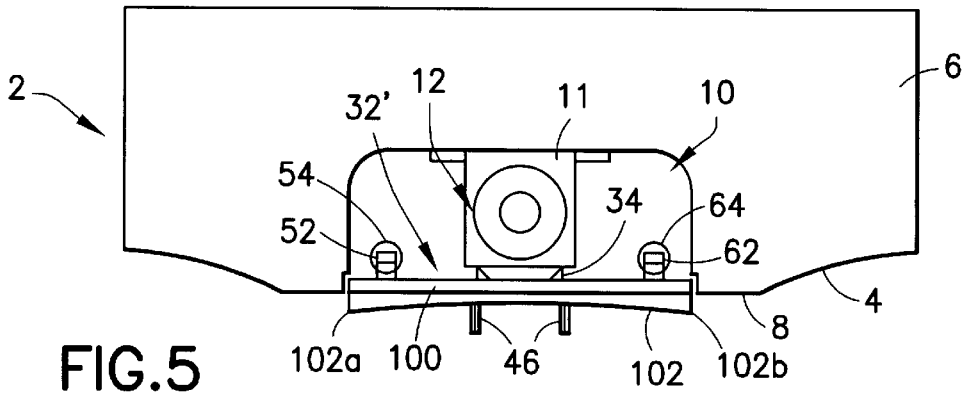
FIG. 5 is a schematic showing a rear elevation view of the watercraft depicted in FIG. 4.

Another preferred embodiment of the invention, shown in FIGS. 4 and 5, uses ski-shaped pads 30' and 32'. Each steering pad comprises a disc-shaped base and a ski-shaped planing surface. The planing surface is a generally cylindrical section with strake-like formations on opposing sides of the planing surface. Preferably, the cross section of the planing surface is curved and concave, forming an upside-down channel for plowing through water to create a reaction or steering force. Each strake-like formation on a side comprises a portion of the curved concave planing surface and a vertical sidewall, which sidewall also produces a steering force when the steering pad moves through the water along a line and the strakes are not parallel to the direction of movement.

As seen in FIG. 4, the planing surface 102 of the rear steering pad 32' protrudes slightly beyond the hull stern. The disc-shaped base 100 is pivotably mounted beneath the water jet propulsion unit in a circular recess having a cutoff portion where the hull ends. As best seen in FIG. 5, the top of the planing surface is slightly below the plane of the hull planing surface 8, which allows the planing surface to turn without the hull planing surface interfering with a rear corner portion of the steering pad planing surface 102. The planing surface 102 has strake-like formations 102*a*, 102*b* on opposing sides and a curved concave cylindrical surface therebetween. Rear steering pad 32' further comprises a pair of skegs 46 projecting generally vertically downward from the planing surface 102 and running generally parallel to the axis of the generally cylindrical surface. The front steering pad also has a pair of skegs 45 and comprises a disc-shaped base which pivotably resides in a circular recess formed in the hull bottom.

The control system shown in FIG. 8 can be used in conjunction with the steering pads shown in FIG. 4. These ski-shaped steering pads produce both a lifting force and a steering force. They can be constructed from metal-reinforced fiberglass and supported by a large taper bearing attached and sealed to the pump housing.

A further preferred embodiment of the invention is shown in FIGS. 6 and 7. In this embodiment, the water jet propulsion unit 12 is incorporated in a pivotable outboard engine comprising a powerhead or motor 106. The means for mounting the outboard engine to the stern of the boat comprise a pair of stern brackets 108 (shown in FIG. 7 only). A swivel bracket (not shown) supports the outboard engine and is pivotably mounted to the stern brackets. The swivel bracket allows the propulsion unit to be tilted about a horizontal axis. The swivel bracket rotatably supports a steering arm assembly, only the vertical pivot column 110 of which is shown in FIG. 6. Pivot column is rigidly connected to the outboard engine, to allow the outboard engine unit to be turned about the axis of the column 110 for steering the boat. FIG. 6 shows the outboard engine in a neutral position and in a steered position.

The front steering pad 30' shown in FIG. 6 is the same as that shown in FIG. 4. The disc-shaped base 100 and the planing surface 102 shown in FIG. 7 are the same as base 100 and surface 102 shown in FIG. 5, except that in FIG. 7 the base is fixedly mounted beneath the water jet propulsion unit 12 instead being pivotably mounted beneath the water jet propulsion unit.

The steerable planing surface disclosed herein forms an effective control surface which increases jet boat performance and provides some steering characteristics of a prop-driven craft. All three designs described above may also incorporate a steering nozzle on the water jet propulsion unit to further enhance control.

While the invention has been described with reference to preferred embodiments, it will be understood by those skilled in the art that various changes may be made and equivalents may be substituted for elements thereof without departing from the scope of the invention. For example, pneumatic cylinders may be used in place of hydraulic cylinders. Alternatively, the connecting links could be replaced by mechanical means powered by electric motors. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "mounted", when used by itself, includes either fixedly mounted or pivotably mounted.

What is claimed is:

1. A jet-powered watercraft comprising:

a hull having a hull planing surface;

a powerhead;

a water jet propulsion unit coupled to said powerhead; and a rear steering pad mounted beneath said water jet propulsion unit and having a first planing surface which is pivotable relative to said hull planing surface and at least one skeg projecting generally vertically downward from said first planing surface along an entire length of said skeg, wherein said powerhead and said water jet propulsion unit are pivotable in unison relative to said hull, said rear steering pad being fixedly mounted beneath and movable in unison with said water jet propulsion unit.

2. A jet-powered watercraft comprising:

a hull having a hull planing surface;

a powerhead;

a water jet propulsion unit coupled to said powerhead, mounted to said hull, and comprising an impeller and a housing surrounding said impeller;

a bearing attached under and sealed to said housing; and a rear steering pad under and pivotably supported by said bearing, said rear steering pad having a first planing surface which is pivotable relative to said hull planing surface, wherein said powerhead is mounted inboard said hull and said water jet propulsion unit extends outboard said hull, and said first planing surface is generally planar and flush with said hull planing surface, said rear steering pad further comprising at least one skeg projecting generally vertically downward from said first planing surface.

3. A jet-powered watercraft comprising:

a hull having a hull planing surface;

a powerhead;

a water jet propulsion unit coupled to said powerhead, mounted to said hull, and comprising an impeller and a housing surrounding said impeller;

a bearing attached under and sealed to said housing; and a rear steering pad under and pivotably supported by said bearing, said rear steering pad having a first planing surface which is pivotable relative to said hull planing surface, wherein said powerhead is mounted inboard said hull and said water jet propulsion unit extends outboard said hull, and said first planing surface is a generally cylindrical section having strake-like sides, said rear steering pad further comprising at least one skeg projecting generally vertically downward from said first planing surface and running generally parallel to said strake-like sides.

4. A jet-powered watercraft comprising:

a hull having a hull planing surface;

a powerhead;

a water jet propulsion unit coupled to said powerhead, mounted to said hull, and comprising an impeller and a housing surrounding said impeller;

a rubber mounting attached to said housing; and a rear steering pad attached to and under said rubber mounting, said rear steering pad having a first planing surface which is pivotable relative to said hull planing surface.

5. A jet-powered watercraft comprising:

a hull having a hull planing surface;

a powerhead;

a water jet propulsion unit coupled to said powerhead, mounted to said hull, and comprising an impeller and a housing surrounding said impeller;

a bearing attached under and sealed to said housing;

a rear steering pad under and pivotably supported by said bearing, said rear steering pad having a first planing surface which is pivotable relative to said hull planing surface;

an actuator arranged inside said hull; and a link penetrating said hull and connecting said actuator to said rear steering pad, wherein said powerhead is mounted inboard said hull and said water jet propulsion unit extends outboard said hull.

6. The watercraft as recited in claim 5, wherein said actuator comprises a hydraulic cylinder.

7. A jet-powered watercraft comprising:

a hull having a hull planing surface;

a powerhead;

a water jet propulsion unit coupled to said powerhead;

a rear steering pad mounted beneath said water jet propulsion unit and having a first planing surface which is pivotable relative to said hull planing surface; and a front steering pad pivotably mounted to said hull and having a second planing surface which is pivotable relative to said hull planing surface, said front steering pad being located forward of said rear steering pad.

8. The watercraft as recited in claim 7, further comprising an operator steering input device and means for turning said front and rear steering pads in opposite directions as a function of the position of said operator steering input device.

9. The watercraft as recited in claim 7, further comprising:

an operator steering input device;

rpm detecting means for detecting revolutions per minute of said powerhead; and means for turning said front steering pad as a function of the position of said operator steering input device only if said rpm detecting means detect that said powerhead is revolving at a number of revolutions per minute which is less than a predetermined threshold.

10. A jet-powered watercraft comprising:

a hull having a planing surface;

a powerhead;

a water jet propulsion unit coupled to said powerhead;

a rear steering pad mounted beneath said water jet propulsion unit and pivotable relative to said planing surface, wherein said rear steering pad comprises a bottom surface and at least one skeg projecting generally vertically downward from said bottom surface;

a front steering pad pivotably mounted to said hull and pivotable relative to said hull planing surface, said front steering pad being located forward of said rear steering pad; and means for enabling steering of said front steering pad only when an rpm level of said powerhead falls below a predetermined threshold.

11. The watercraft as recited in claim 10, wherein said powerhead and said water jet propulsion unit are pivotable in unison relative to said hull, said rear steering pad being fixedly mounted beneath said water jet propulsion unit.

12. The watercraft as recited in claim 10, wherein said powerhead is mounted inboard said hull and said water jet propulsion unit extends outboard said hull, said rear steering pad being pivotably mounted beneath said water jet propulsion unit.

13. The watercraft as recited in claim 10, wherein said bottom surface of said rear steering pad is generally planar and flush with said planing surface.

14. The watercraft as recited in claim 10, wherein said bottom surface of said rear steering pad is generally circular, said rear steering pad residing in an opening in said planing surface defined in part by a semicircle of radius greater than a radius of said generally circular bottom surface of said rear steering pad.

15. The watercraft as recited in claim 10, wherein a portion of said rear steering pad is generally circular, said generally circular portion of said rear steering pad residing in an opening in said planing surface defined in part by a semicircle of radius greater than a radius of said generally circular portion of sa d rear steering pad.

16. The watercraft as recited in claim 10, wherein said bottom surface of said rear steering pad is a generally cylindrical section having strake-like sides, said at least one skeg running generally parallel to said strake-like sides.

17. The watercraft as recited in claim 10, further comprising an actuator arranged inside said hull, and a link penetrating said hull and connecting said actuator to said rear steering pad.

18. The watercraft as recited in claim 10, further comprising an operator steering input device and means for turning said front and rear steering pads in opposite directions as a function of the position of said operator steering input device when said steering enabling means have detected a powerhead rpm level less than said predetermined threshold.

19. An apparatus comprising:

a water jet propulsion unit comprising an impeller and a housing surrounding said impeller;

a bearing attached under and sealed to said housing; and a steering pad pivotably supported by said bearing and pivotable relative to said housing of said water jet propulsion unit, wherein said steering pad comprises a bottom surface and at least one skeg projecting generally vertically downward from said bottom surface along an entire length of said skeg.

20. The apparatus as recited in claim 19, wherein said bottom surface of said steering pad is generally planar and a midplane of said at least one skeg is generally perpendicular to said generally planar bottom surface.

21. The apparatus as recited in claim 19, wherein said bottom surface of said steering pad is a generally cylindrical section having strake-like sides, and an axis of said at least one skeg is generally parallel to said strake-like sides.

* * * * *